US009902406B2

(12) United States Patent
Guzman et al.

(10) Patent No.: US 9,902,406 B2
(45) Date of Patent: Feb. 27, 2018

(54) COMMUTER TRAIN AND RAILWAY CAR EXIT LADDER ASSEMBLY AND METHODS OF STORAGE AND USE

(71) Applicant: RAILCAR PARTS MANUFACTURING, INC., Signal Hill, CA (US)

(72) Inventors: Carlos Guzman, Signal Hill, CA (US); John Guzman, Signal Hill, CA (US)

( * ) Notice: Subject to any disclaimer, the term of this patent is extended or adjusted under 35 U.S.C. 154(b) by 105 days.

(21) Appl. No.: 14/167,634

(22) Filed: Jan. 29, 2014

(65) Prior Publication Data

US 2015/0013565 A1 Jan. 15, 2015

Related U.S. Application Data

(60) Provisional application No. 61/757,844, filed on Jan. 29, 2013.

(51) Int. Cl.
*B61D 23/02* (2006.01)

(52) U.S. Cl.
CPC ..... *B61D 23/02* (2013.01)

(58) Field of Classification Search
CPC ..... B61D 19/00; B61D 19/02; B61D 19/023; B61D 19/026; E06C 7/44
USPC ..... 105/343, 344, 348, 349, 443, 447, 448, 105/449
See application file for complete search history.

(56) References Cited

U.S. PATENT DOCUMENTS 808,076 A * 12/1905 Felkner ..... B60J 9/02 105/438
3,374,860 A * 3/1968 Stewart ..... E06C 7/44 182/204
3,791,487 A * 2/1974 Baumann ..... E06C 7/44 182/201
4,021,071 A * 5/1977 Norman ..... E02F 9/0833 182/84
4,615,275 A * 10/1986 Ishizuka ..... B61D 19/023 105/348

(Continued)

*Primary Examiner* — Robert J McCarry, Jr.
(74) *Attorney, Agent, or Firm* — Sandra Thompson; Finlayson Toffer Roosevelt & Lilly LLP

(57) ABSTRACT

Contemplated ladder assemblies include: a) at least two rails, b) at least one step, wherein each step is coupled to the at least two rails, such that the rails are relatively vertical and the steps are relatively horizontal, c) at least one grappling footing peg, wherein the peg is operationally coupled with a rail, d) at least one safety handle, wherein the handle is coupled with at least one rail, and e) at least one commuter train, passenger train or railway car coupling fixture, wherein the coupling fixture operationally engages with a mating fixture on the commuter train, passenger train or railway car. In addition, contemplated ladder assemblies for use with a commuter train, a passenger train or a railway car include: at least two rails, at least one step, wherein each step is coupled to the at least two rails, such that the rails are relatively vertical and the steps are relatively horizontal, at least one grappling footing peg, wherein the peg is operationally coupled with a rail, at least one safety handle, wherein the handle is coupled with at least one rail, and at least one commuter train, passenger train or railway car coupling fixture, wherein the coupling fixture operationally engages with the ladder assembly.

18 Claims, 6 Drawing Sheets

(56) References Cited

U.S. PATENT DOCUMENTS 6,435,306 B2 * 8/2002 Stoneburg ..... E06C 7/44
182/200
6,948,591 B2 * 9/2005 Scott ..... E06C 7/44
182/201

* cited by examiner

COMMUTER TRAIN AND RAILWAY CAR EXIT LADDER ASSEMBLY AND METHODS OF STORAGE AND USE

This U.S. Utility Patent Application claims priority to U.S. Provisional Patent Application Ser. No. 61/757,844 filed on Jan. 29, 2013, which is entitled "Commuter Train and Railway Car Exit Ladder and Methods of Storage and Use" and which is commonly-owned and incorporated herein in its entirety by reference.

FIELD OF THE SUBJECT MATTER

The field of the subject matter is an exit ladder assembly for use with commuter trains and railway cars, such as Amtrak trains, including methods of storage and use.

BACKGROUND

Commuter trains, including those that run both underground and above-ground, are utilized by millions of people each day. Railway cars and trains that travel longer distances, such as high speed rail and Amtrak, use these same tracks and stations to pick up and drop off passengers.

Most of these trains are either level with the platform or require one step to get from the train to the platform. If a step is required, it is usually permanently attached to the train by the door. When the train pulls out of the station, the door is elevated usually several feet above the ground. This design feature can present a significant problem, if the train is forced to stop and the passengers are forced to exit the train between stations, such as in an emergency.

Therefore, there is a need in the industry for a removable and storable ladder assembly for commuter trains, passenger trains and railway cars, wherein the ladder assembly is: a) easily stored near the doors of the train or railway car without getting in the way of passengers, b) easily removable from the storage area, c) easily transported to the door where the passengers need to exit, and d) easily and securely locked in place, so that passengers can safely exit the train or railcar in an emergency.

SUMMARY OF THE SUBJECT MATTER

Contemplated ladder assemblies include: a) at least two rails, b) at least one step, wherein each step is coupled to the at least two rails, such that the rails are relatively vertical and the steps are relatively horizontal, c) at least one grappling footing peg, wherein the peg is operationally coupled with a rail, d) at least one safety handle, wherein the handle is coupled with at least one rail, and e) at least one commuter train, passenger train or railway car coupling fixture, wherein the coupling fixture operationally engages with a mating fixture on the commuter train, passenger train or railway car.

In addition, contemplated ladder assemblies for use with a commuter train, a passenger train or a railway car include: a) at least two rails, b) at least one step, wherein each step is coupled to the at least two rails, such that the rails are relatively vertical and the steps are relatively horizontal, c) at least one grappling footing peg, wherein the peg is operationally coupled with a rail, d) at least one safety handle, wherein the handle is coupled with at least one rail, and e) at least one commuter train, passenger train or railway car coupling fixture, wherein the coupling fixture operationally engages with the ladder assembly.

DETAILED DESCRIPTION

A ladder assembly has been developed that allows passengers to safely exit a train no matter how far the door is above the ground, and a contemplated ladder assembly and how it is coupled to a commuter train or railway car is shown in the Figures included and will be described in detail herein. Contemplated ladder assemblies are designed such that passengers can exit the train as quickly and safely as possible. For example, contemplated ladders are designed and angled such that the passengers can exit the train facing forward and not facing into the train car.

Specifically, a removable and storable ladder assembly for commuter trains, passenger trains and railway cars has been developed, wherein the ladder assembly is: a) easily stored near the doors of the train or railway car without getting in the way of passengers, b) easily removable from the storage area, c) easily transported to the door where the passengers need to exit, and d) easily and securely locked in place, so that passengers can safely exit the train or railcar in an emergency. It should be understood that an "emergency", as it is used herein, is any unscheduled or emergency stop of a commuter train, passenger train or railway car, where the stop also isn't at a designated train station.

Figure 1:
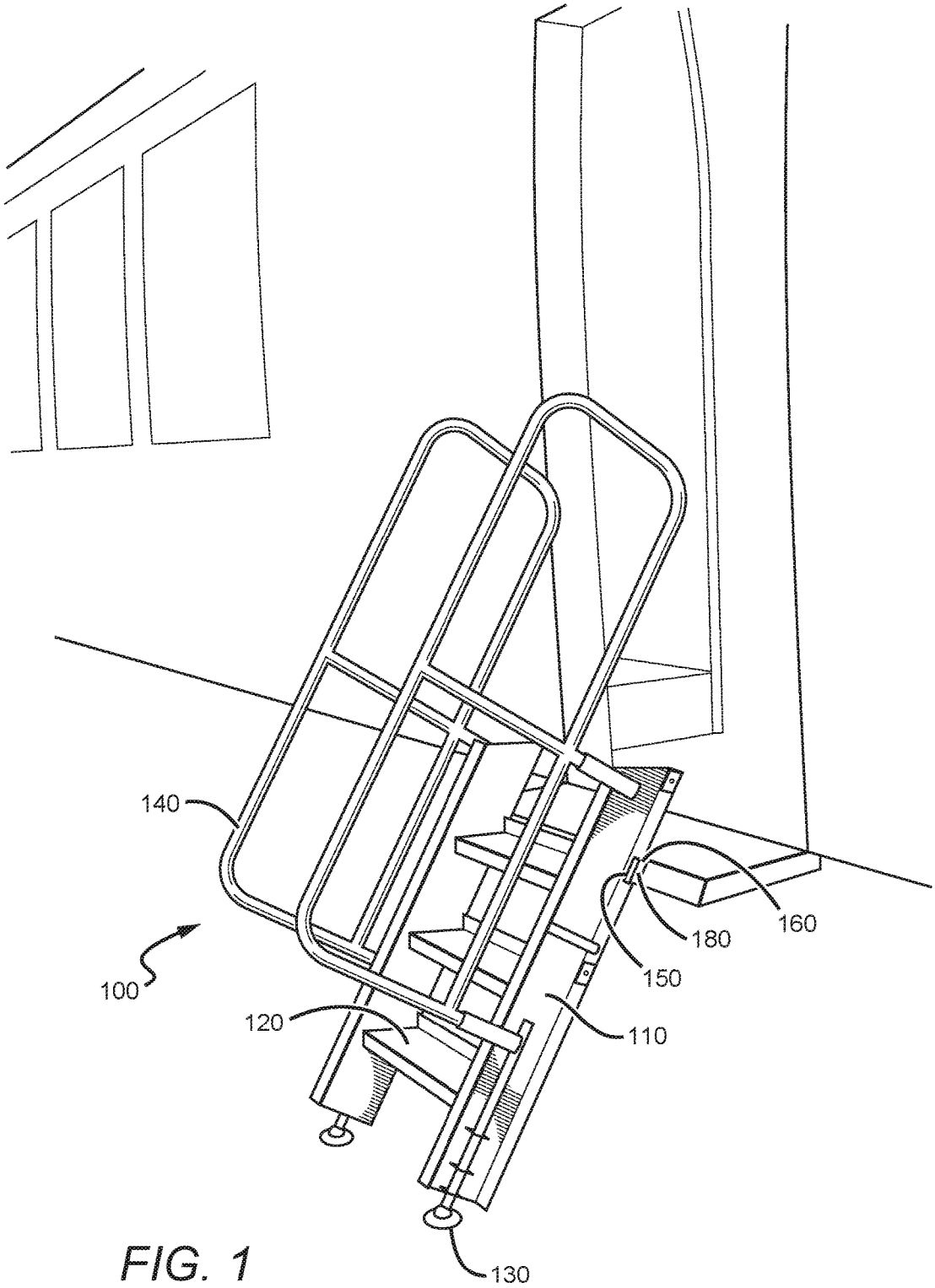
FIG. 1 shows a contemplated ladder assembly.
Figure 2:
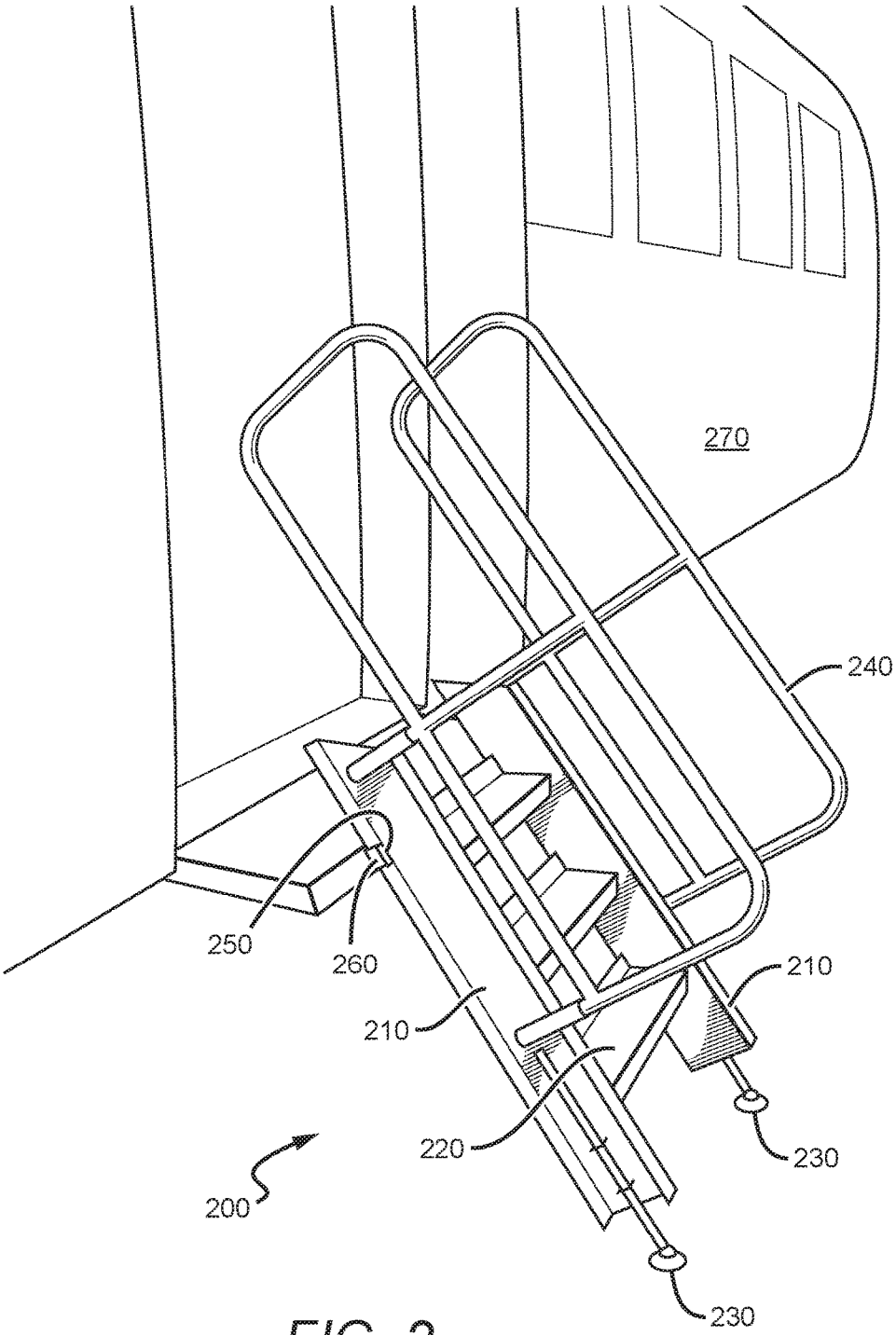
FIG. 2 shows a contemplated ladder assembly.

Contemplated ladder assemblies 100 and 200 include and are shown in FIG. 1 and FIG. 2: a) at least two rails 110 and 210, b) at least one step 120 and 220, wherein each step is coupled to the at least two rails 110 and 210, such that the rails are relatively vertical and the steps are relatively horizontal, c) at least one grappling footing peg 130 and 230, wherein the peg is operationally coupled with a rail 110 and 210 and is designed to contact the ground and provide stability to the ladder assembly 100 and 200, d) at least one safety handle 140 and 240, wherein the handle is coupled with at least one rail 110 and 210, and e) at least one commuter train, passenger train or railway car coupling fixture 150 and 250, wherein the coupling fixture operationally engages with a mating fixture 160 and 260 on the commuter train, passenger train or railway car 170 and 270. Also in this embodiment, a locking device 180 is coupled to the ladder assembly and is designed to feed through a hole (not shown) on the coupling fixture 150 and mating fixture 160 on the railway car, such that the ladder assembly 100 is temporarily coupled with the step 190. A close-up view of this particular mechanism is shown in FIG. 5.

Figure 5:
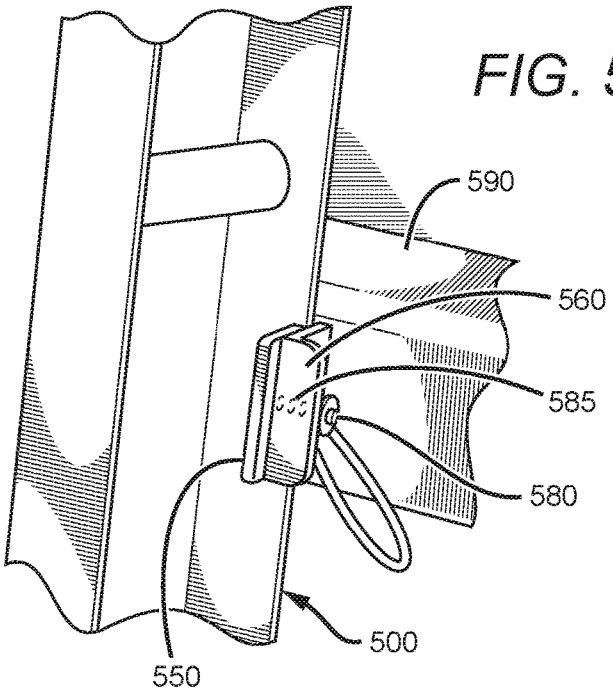
FIG. 5 shows a close-up view of the coupling mechanism used to temporarily attach the ladder assembly to the step of at least one commuter train, passenger train or railway car (not shown).

FIG. 5, as mentioned, shows a close-up view of the coupling mechanism used to temporarily attach the ladder assembly 500 to the step 590 of at least one commuter train, passenger train or railway car (not shown). A contemplated coupling fixture 550 operationally engages with a mating fixture 560 on the commuter train, passenger train or railway car step 590. Also in this embodiment, a locking device 580 is coupled to the ladder assembly and is designed to feed through a hole 585 on the coupling fixture 550 and mating fixture 560 on the railway car, such that the ladder assembly 500 is temporarily coupled with the step 590.

Contemplated ladder assemblies comprise at least one step, as disclosed earlier, and it is understood that each step has a front portion that is at the greatest distance from the commuter train, a passenger train or a railway car and a back portion that is at the shortest distance from the commuter train, a passenger train or a railway car. Each step has a top portion that extends between the front portion and the back portion and is designed to support the foot or feet of a passenger. In some embodiments, each step may be rotatably affixed to each rail, so that the steps can be rotated from a horizontal plane to a more vertical plane to aid storage of the ladder assembly on a train or in a railway car.

Figure 6:
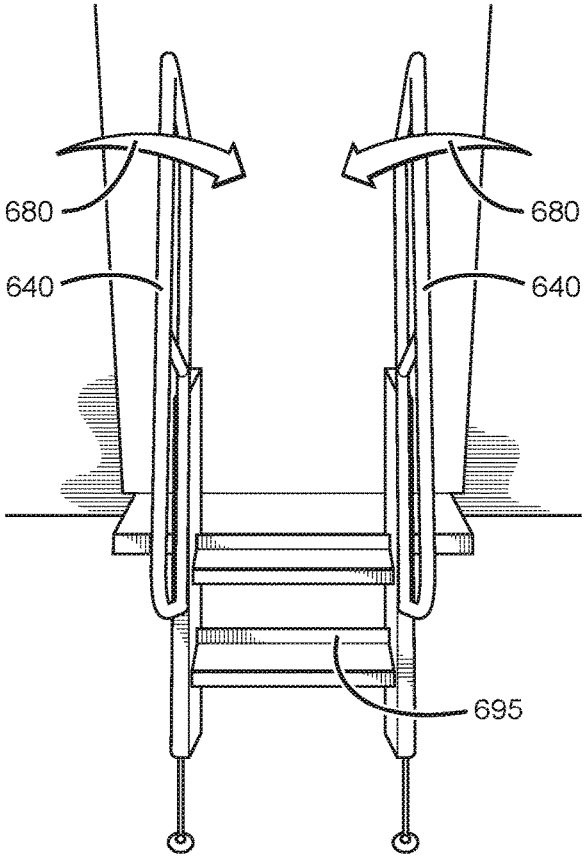
FIG. 6 shows a contemplated embodiment where the safety handles are rotated on a 90 degree vertical axis to collapse and lay flat on a ladder assembly.

In contemplated embodiments, each step comprises a safety kick plate that is coupled to the back portion of the step and is at approximately a 90 degree angle with the top portion of the step. A contemplated kick plate is shown in FIG. 6 as reference number 695 and holds the passenger heel in place just in case the foot slips backwards while the passenger is walking down the stairs. This is important especially for commuter trains, where women may have shoes with heels on them. Contemplated ladder assemblies are also marked in key and strategic places for safety purposes, including markings on the handrails and rungs.

Contemplated ladder assemblies comprise multi-directional grappling footing pegs that can securely stabilize the ladder on any type of sediment or concrete. These footing pegs also are spring-loaded or otherwise telescoping so that they can reach and put force on the ground in order to stabilize the ladder when the ladder assembly is in use. In contemplated embodiments, the at least one grappling footing peg is extendable from a stored position in order to engage with the ground. In other embodiments, the at least one grappling footing peg is spring-loaded, telescoping or a combination thereof.

Figure 3:
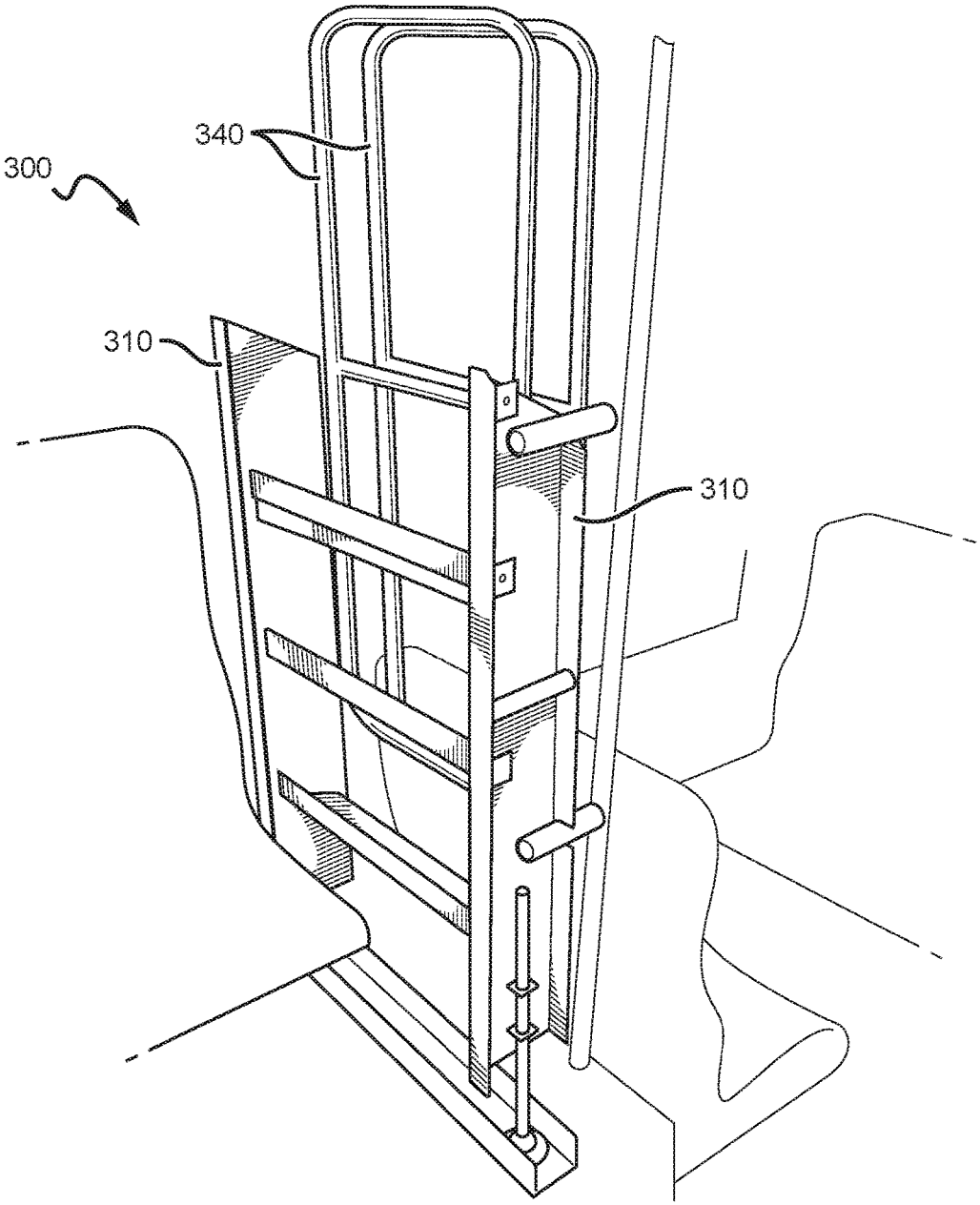
FIG. 3 shows a contemplated ladder assembly that has been collapsed for storage and is in storage on the inside of a train car or railway car.

FIG. 3 shows a contemplated ladder assembly 300 that is being stored inside the train or railway car (not shown), such that it can be easily removed from storage, assembled quickly and used to exit the car in an emergency. In this embodiment, the at least one safety handle 340 is removed from the at least two rails 310 and stored with the rest of the ladder assembly 300. In some contemplated embodiments, each of the safety handles 340 may be folded in on the ladder assembly 300, so that the handles remain connected to the ladder assembly. In this embodiment, the left safety handle will be folded in a 90 degree angle to the right and the right safety handle will be folded in a 90 degree angle to the left, such that they lay flat on one another and lay flat on the ladder assembly. FIG. 6 shows directional arrows 680 indicating how the safety handles 640 may be folded to produce the stored ladder assembly 300.

Figure 4:
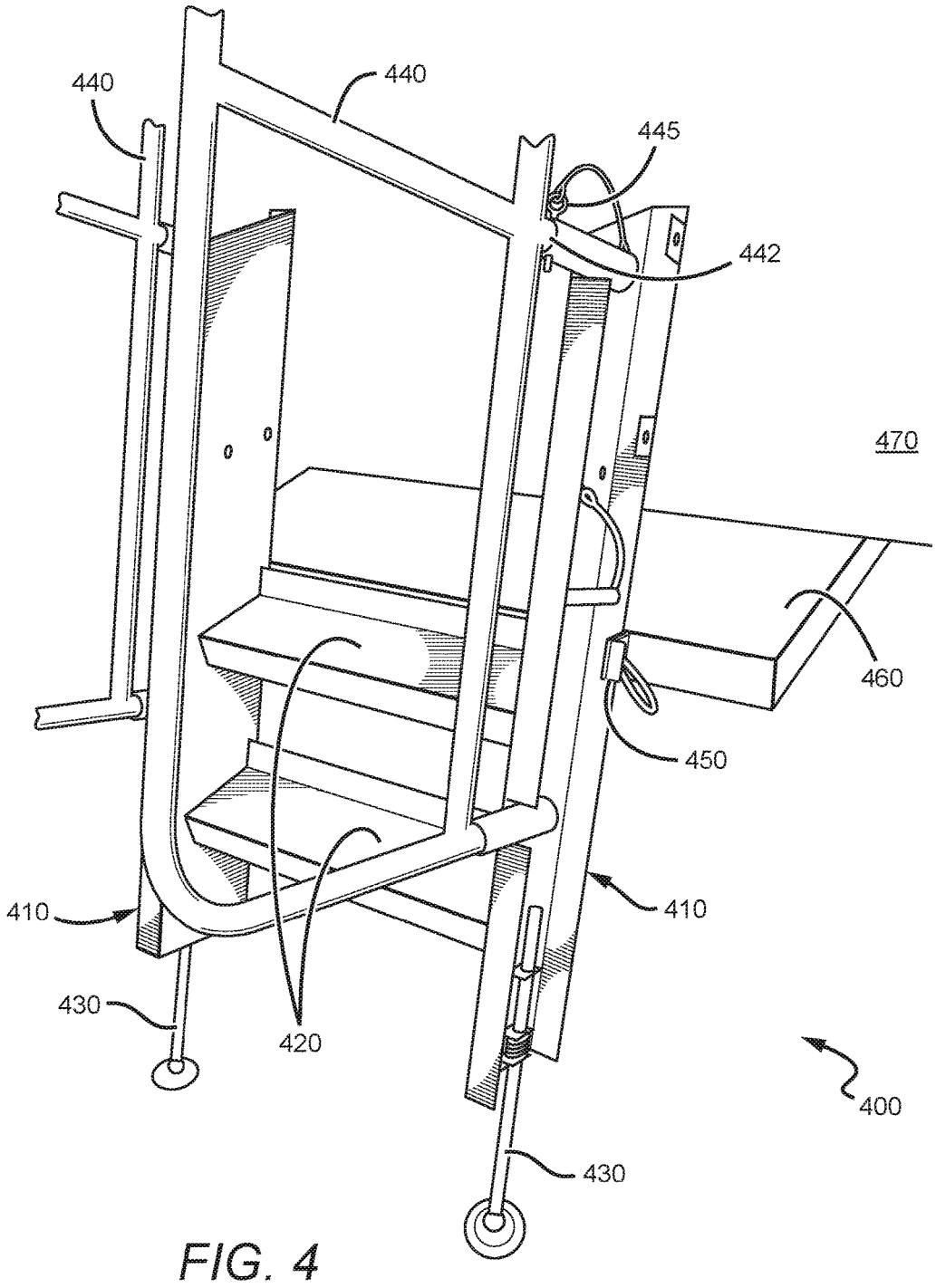
FIG. 4 shows another contemplated ladder assembly.

In addition, a contemplated ladder assembly 400 for use with a commuter train, a passenger train or a railway car is shown in FIG. 4 and includes: a) at least two rails 410, b) at least one step 420, wherein each step is coupled to the at least two rails 410, such that the rails are relatively vertical and the steps are relatively horizontal, c) at least one grappling footing peg 430, wherein the peg 430 is operationally coupled with a rail 410 and is designed to contact the ground and provide stability to the ladder assembly 400, d) at least one safety handle 440, wherein the handle 440 is coupled with at least one rail 410, and e) at least one commuter train, passenger train or railway car coupling fixture 450, wherein the coupling fixture 450 operationally engages with the ladder assembly 400 and is permanently fixed to a step 460 on the commuter train, passenger train or railway car 470. In this embodiment, the at least one safety handle 440 removably slides into mating openings 442 and are held in place with removable pins 445.

Figure 7:
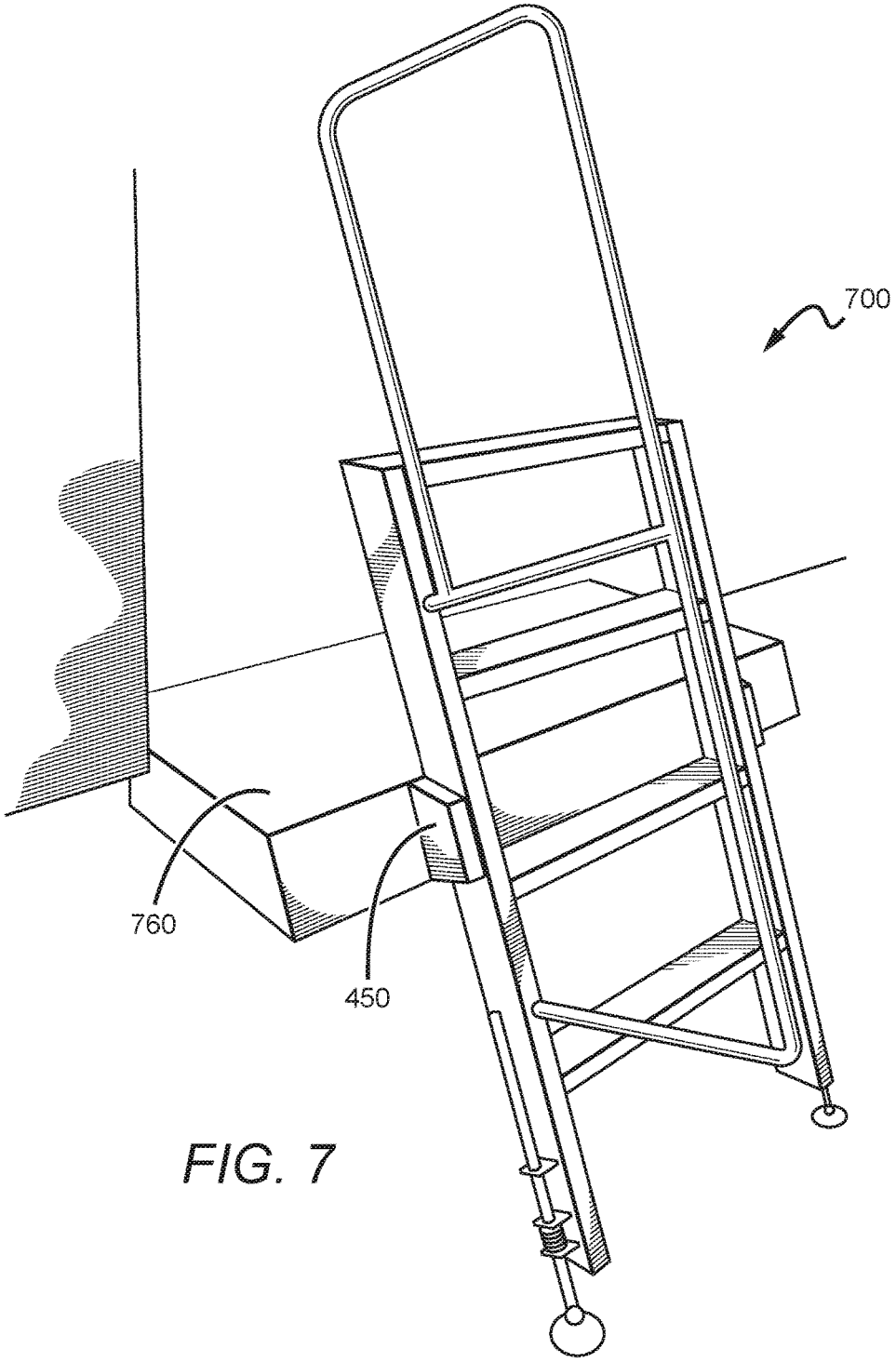
FIG. 7 shows another contemplated ladder assembly.

A contemplated coupling fixture 450 is shown in FIG. 7, where the coupling fixture 750 is permanently fixed to the step 760 and operationally engages or couples with the ladder assembly 700 to hold it in place. In this embodiment, the ladder assembly is temporarily held in place and there are no locking pins or connecting mechanisms to physically attach the step to the ladder assembly, as there are in earlier embodiments. As is clear, the ladder assembly 700 is prevented from moving from side-to-side as the passengers (not shown) exit the train.

Ladder assemblies comprise handles that fold up when the ladder is in storage and then fold out when the ladder is in use. In some contemplated embodiments, there are locking pegs or devices on the ladder assembly that hold the handles in place and steady during use, as previously disclosed.

As disclosed earlier, the ladder assembly is designed to securely fasten to the train with the use of a fastening attachment or coupling fixture and a corresponding mating fixture in some embodiments. Contemplated fastening attachments are customizable based on the type of railcar being used with the ladder assembly. There are locking bolts or securing apparatus that locks the ladder assembly securely in place on the train car. In some embodiments, the coupling fixture is on the train or railcar and is designed to hold the ladder assembly securely in place.

Contemplated ladder assemblies can be made from any suitable material, as long as the ladder is strong and able to be stored and used repeatedly. In some embodiments, the ladder assembly is made from aluminum, but it could also be made from a combination of materials, including plastics and composites, along with other metals and materials.

Thus, specific embodiments of exit ladders and ladder assemblies for use with commuter trains and railway cars, such as Amtrak trains, including methods of storage and use thereof have been disclosed. It should be apparent, however, to those skilled in the art that many more modifications besides those already described are possible without departing from the inventive concepts herein. The inventive subject matter, therefore, is not to be restricted except in the spirit of the disclosure herein. Moreover, in interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

We claim:

1. A ladder assembly for use with a commuter train, a passenger train or a railway car, comprising:

at least two rails, at least one step, wherein each step is coupled to the at least two rails, such that the rails are relatively vertical and the steps are relatively horizontal, at least two spring-loaded grappling footing pegs, wherein each peg is operationally coupled with a corresponding rail and physically separated from the at least one step and contacts a section of the ground, sediment or concrete to provide stability to the ladder assembly, at least one safety handle, wherein the handle is coupled with at least one rail and wherein the handle is made from aluminum, metal, plastic or a combination thereof, and at least one commuter train, passenger train or railway car coupling fixture or fastening attachment, wherein the coupling fixture or fastening attachment operationally and removably engages with a mating fixture on the commuter train, passenger train or railway car, wherein the ladder assembly is removable and storable for use in an emergency or unscheduled stop and wherein the ladder assembly is securely locked into place by a passenger using the coupling fixture or fastening attachment on the commuter train, the passenger train or the railcar before exiting the commuter train, the passenger train or the railcar in an unscheduled or emergency stop.

2. The ladder assembly of claim 1, wherein each step has a front portion that is at the greatest distance, relative to the rest of the step, from the commuter train, a passenger train or a railway car.

3. The ladder assembly of claim 1, wherein each step has a back portion that is at the shortest distance, relative to the rest of the step, from the commuter train, a passenger train or a railway car.

4. The ladder assembly of claim 1, wherein each step has a top portion that extends between the front portion and the back portion and is designed to support the foot or feet of a passenger.

5. The ladder assembly of claim 3, wherein each step comprises a safety kick plate that is coupled to the back portion of the step and is at approximately a 90 degree angle with the top portion of the step.

6. The ladder assembly of claim 1, wherein the at least two grappling footing pegs are additionally telescoping.

7. The ladder assembly of claim 1, wherein the at least one safety handle is removable from the rail.

8. The ladder assembly of claim 7, wherein the at least one safety handle is storable with the ladder assembly after removal from the rail.

9. The ladder assembly of claim 1, wherein the at least one safety handle is collapsible in order to lay flat against the ladder assembly.

10. The ladder assembly of claim 9, wherein each safety handle rotates on a vertical axis at a 90 degree angle to lay flat against the ladder assembly.

11. A ladder assembly for use with a commuter train, a passenger train or a railway car, comprising:

at least two rails, at least one step, wherein each step is coupled to the at least two rails, such that the rails are relatively vertical and the steps are relatively horizontal, at least two spring-loaded grappling footing pegs, wherein each peg is operationally coupled with a corresponding rail and physically separated from the at least one step and contacts a section of the ground, sediment or concrete to provide stability to the ladder assembly, at least one safety handle, wherein the handle is coupled with at least one rail and wherein the handle is made from aluminum, metal, plastic or a combination thereof, and at least one commuter train, passenger train or railway car coupling fixture or fastening attachment, wherein the coupling fixture or fastening attachment operationally and removably engages with a mating fixture on the commuter train, passenger train or railway car, wherein the ladder assembly is removable and storable for use in an emergency or unscheduled stop and wherein the ladder assembly is securely locked into place by a passenger using the coupling fixture or fastening attachment on the commuter train, the passenger train or the railcar before exiting the commuter train, the passenger train or the railcar in an unscheduled or emergency stop.

12. The ladder assembly of claim 11, wherein the at least one coupling fixture couples with each rail of the ladder assembly.

13. The ladder assembly of claim 11, wherein the at least one coupling fixture is utilized to hold or secure the ladder assembly from moving side-to-side in a horizontal direction.

14. The ladder assembly of claim 11, wherein each step has a front portion that is at the greatest distance, relative to the rest of the step, from the commuter train, a passenger train or a railway car.

15. The ladder assembly of claim 11, wherein each step has a back portion that is at the shortest distance, relative to the rest of the step, from the commuter train, a passenger train or a railway car.

16. The ladder assembly of claim 11, wherein each step has a top portion that extends between the front portion and the back portion and is designed to support the foot or feet of a passenger.

17. The ladder assembly of claim 16, wherein each step comprises a safety kick plate that is coupled to the back portion of the step and is at approximately a 90degree angle with the top portion of the step.

18. The ladder assembly of claim 11, wherein the at least two grappling footing pegs are additionally telescoping.

* * * * *